United States Patent [19]

Giulie

[11] Patent Number: 4,706,533

[45] Date of Patent: Nov. 17, 1987

[54] SHEAR PUNCH

[76] Inventor: Joe D. Giulie, 1086 E. Meadow Cir., Palo Alto, Calif. 94303

[21] Appl. No.: 868,276

[22] Filed: May 29, 1986

[51] Int. Cl.[4] ..... B26F 1/14; B26F 1/44

[52] U.S. Cl. ..... 83/599; 83/604; 83/660; 83/698

[58] Field of Search ..... 83/689, 604, 691, 695, 83/599, 598, 660, 570; 412/6, 7, 40, 38

[56] References Cited

U.S. PATENT DOCUMENTS

| | | | |
|---|---|---|---|
| 1,667,196 | 4/1928 | Darling | 83/599 X |
| 3,434,907 | 3/1969 | Philippi et al. | 83/660 X |
| 3,635,111 | 1/1972 | Zieg et al. | 83/689 X |
| 3,996,831 | 12/1976 | Gale | 83/604 |

FOREIGN PATENT DOCUMENTS

| | | | |
|---|---|---|---|
| 1123712 | 8/1968 | United Kingdom | 83/660 |

*Primary Examiner*—Donald R. Schran

[57] ABSTRACT

A punch is provided having a novel tooth configuration wherein the tooth has piercing points at the centers of the extreme ends of a rectangular shank with an arcuate surface connecting the two points and with four concave surfaces connecting the sides of the arcuate surface with flat sides of the rectangular shank. The punch has a double action wherein it first pierces the paper and then shears the side walls so that a minimum amount of energy is necessary.

4 Claims, 9 Drawing Figures

SHEAR PUNCH

SUMMARY OF THE INVENTION

The present invention relates to a punch for punching one or more holes in a sheaf of papers. In accordance with the preferred embodiment of the invention, a plurality of holes can be punched for the reception of a binding element such as a spiral binder.

The punch of the present invention has a novel tooth design so that a minimum amount of energy is necessary in punching one or more holes in a sheaf of paper and the holes have extremely clean edges.

The punch is of simple design and there are no complex mating parts.

The most important feature of the present invention is the shape of the tooth or male punch element. The tooth has a generally rectangular shank and at the center of the ends of the shank, points are provided. A concave arcuate surface connects the two points. Also, the shank slopes inwardly, i.e. has concave surfaces, at the sides to connect the flat side surfaces of the shank with arcuate surfaces between the points.

By using this configuration, the two points first pierce the paper and then as the punch descends farther, the rectangular sides of the punch shear the paper against a rectangular female element. Thus, the punch operates with a minimum amount of pressure and produces extremely clean rectangular holes.

In accordance with the preferred embodiment of the invention, a plurality of such punches are located on a single backing member so that a plurality of holes can be punched in a sheaf of paper at once. This is particularly advantageous for the insertion of binding elements and particularly spiral binding elements.

When a plurality of punches are located on a single backing member, they can be advantageously arranged in such a way that they do not all contact a sheaf of paper at the same time but instead attack the paper one at a time. Thus, one is punching a single hole at any given moment which results in a minimum expenditure of energy.

In still another embodiment of the invention, a toggle linkage is employed to actuate the punch so that the linkage provides increasing mechanical advantage as the lever moves down to compensate for the mechanical advantage decrease on the punch member per se.

Other objects and features of the invention will be brought out in the balance of the specification.

DESCRIPTION OF THE PREFERRED EMBODIMENTS

Figure 1:
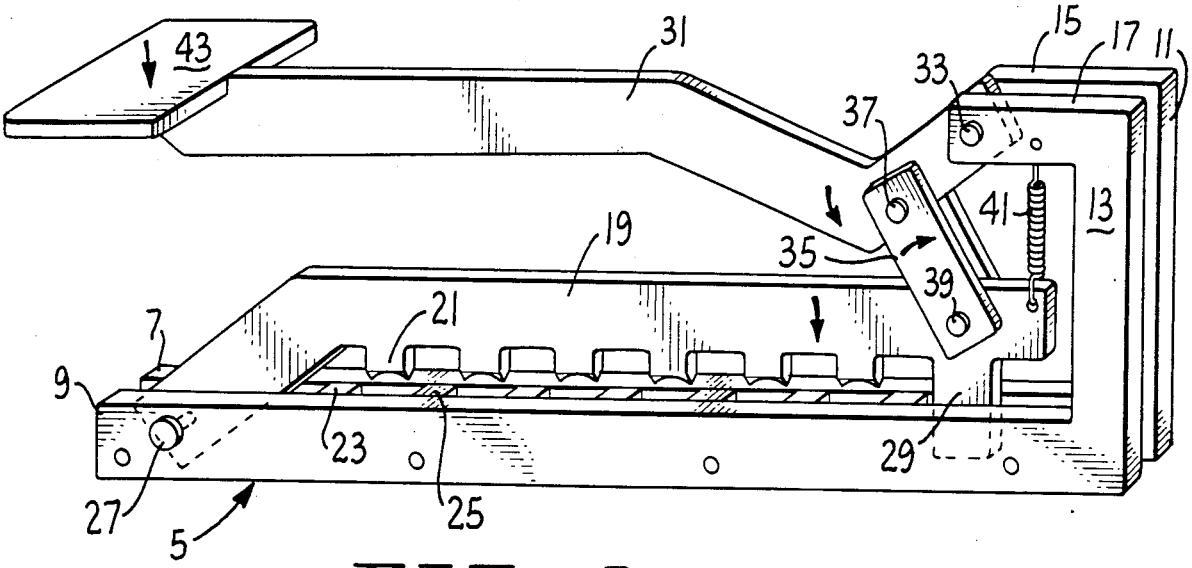
FIG. 1 is a perspective view of a toggle actuated punch embodying the present invention.
Figure 2:
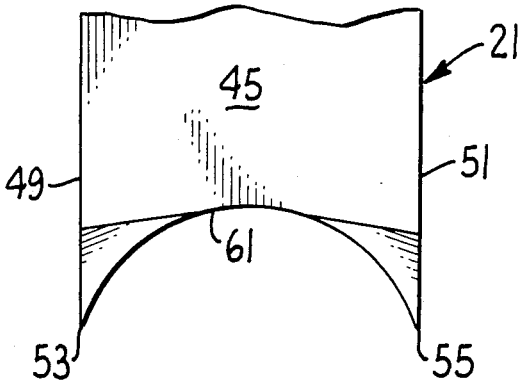
FIG. 2 is an enlarged side view of a male punch element.
Figure 3:
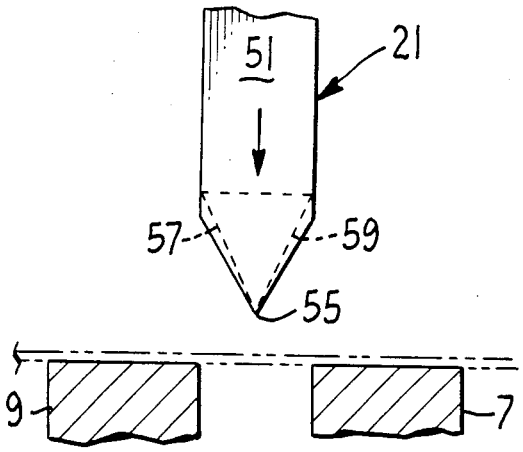
FIG. 3 is an end view of the male punch element and also showing in section a portion of the female punch member.
Figure 4:
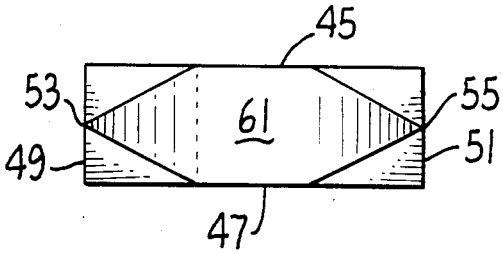
FIG. 4 is a bottom plan view of the tooth shown in FIG. 2.
Figure 5:
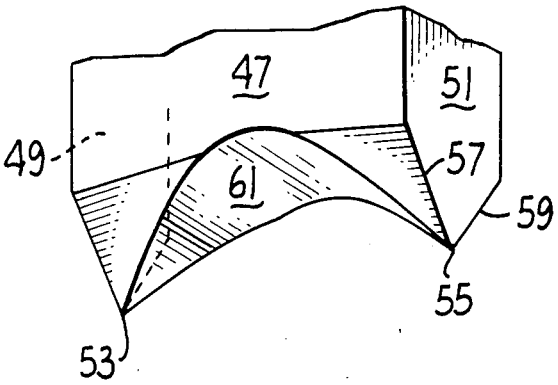
FIG. 5 is a perspective view of the bottom portion of the tooth.

Refering now to the drawings by reference characters, the punch shown in FIG. 1 has a base member generally designated 5 which consists of two spaced apart elements 7 and 9. The spacing between the elements 7 and 9 would ordinarily be that of the short dimension of the holes to be punched. The members 7 and 9 have upstanding ends respectively 11 and 13 with arms 15 and 17 extending back over the lower portion of the frame members. The punch proper consists of a back member 19 having a plurality of male punch members one of which has been designated 21. The exact structure of these punch members will be brought out in the future. The frame members 7 and 9 have separators as at 23 and 25 and are not critical but merely keep the paper from deforming into the long slot. The backing member is pivoted at 27 on the frame member. The opposite end is provided with a guide member 29 which passes down between frame members 7 and 9 past the edge of the paper being punched. The handle has a long lever arm 31 which is pivoted to the arms 15 and 17 at point 33. The end of the lever arm is bent as shown and this cooperates with a toggle arm 35 which is pivoted the lever arm at point 37 and pivoted to the backing member 19 at point 39. A relatively weak spring 41 is employed which is of sufficient strength to lift back member 19. In order to utilize the punch, a sheaf of papers would be placed between the male and female elements and handle 43 pressed. The toggle provides a mechanical advantage which increases as the lever moves down to compensate for the mechanical advantage decrease on the punch member.

The male punch element is shown in FIGS. 2–5. The punch has a rectangular shank including the sides 45 and 47 and the ends 49 and 51. At the extreme ends are formed the points 53 and 55. The sides are tapered upwardly to the rectangular portion of the punch as is shown at 57 and 59. An arcuate surface 61 connects the two points 53 and 59. The areas between the tapered end, e.g. 57 and 59, are concave and substantially represent a segment of a sphere.

The action of a tooth shaped in this manner is that the points 53 and 55 first pierce small cuts in the paper and then as the punch descends, the angling faces of the edges 57 and 59 cut the sides of the holes by a shearing action as the sides 45 and 47 enter the paper. Thus, by combining an initial piercing action followed by a shearing action, a minimal amount of force is necessary to punch the paper and no critical alignment of individual punches is required.

Figure 6:
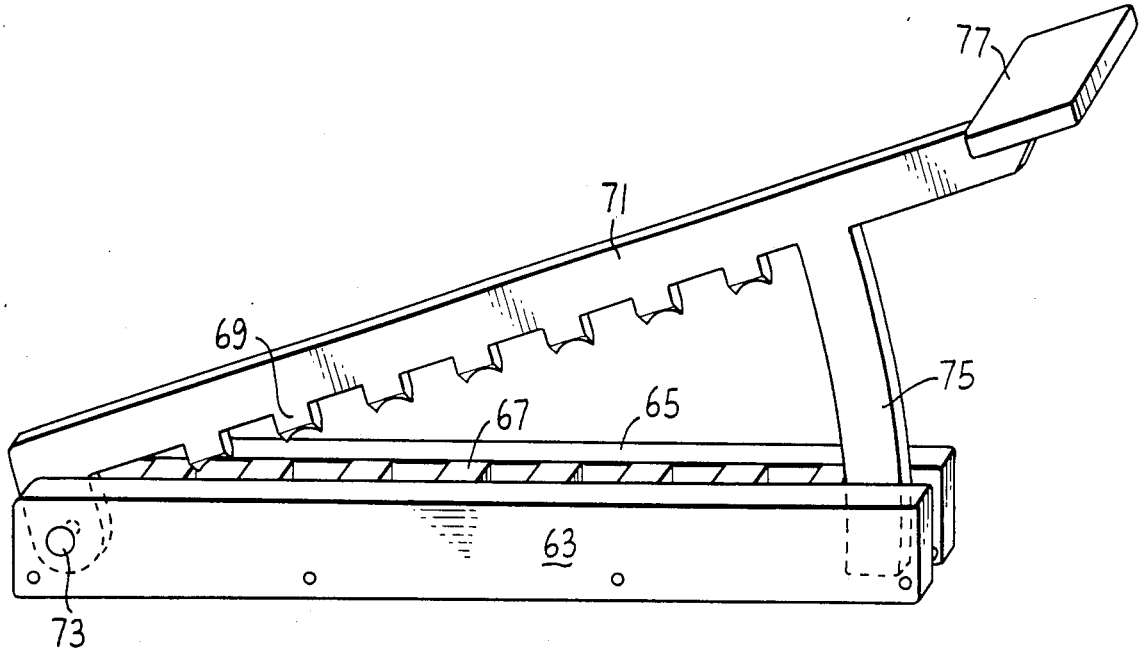
FIG. 6 is perspective view of another embodiment of the invention showing a structure wherein the teeth enter the sheaf of paper one at a time.

In FIG. 6 another embodiment of the invention is shown which does not require the toggle action but wherein the punch punches the holes serially so that relatively little force is required. Thus, in this embodiment of the invention the sides of the female element 63 and 65 are held in spaced relationship by means of the spacer elements 67. Obviously, the separation between the elements 63 and 65 represent the width of a slot to be punched. The male punch elements such as 69 are held on a bar 71 which is pivoted at point 73 to the bar 63. A guide 75 is provided near one end of the bar 71 and this serves to keep the parts in alignment. Handle 77 is disposed at the end of the bar. It can be seen that the holes are punched one at a time, beginning at the pivot end, as the bar 71 descends.

Figure 7:
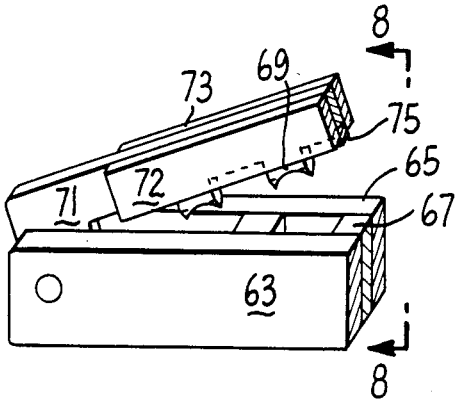
FIG. 7 is a partial view in section of the hinge end of another embodiment.
Figure 8:
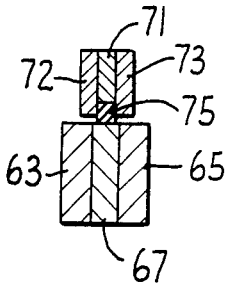
FIG. 8 is a section on the line 8—8 of FIG. 7.

As is shown in FIG. 7, the bar supporting the male punch elements may be reinforced with the side members 72 and 73. Also, this embodiment of the invention, a small rubber insert 75 is provided to reduce the shock as the punch goes down.

Figure 9:
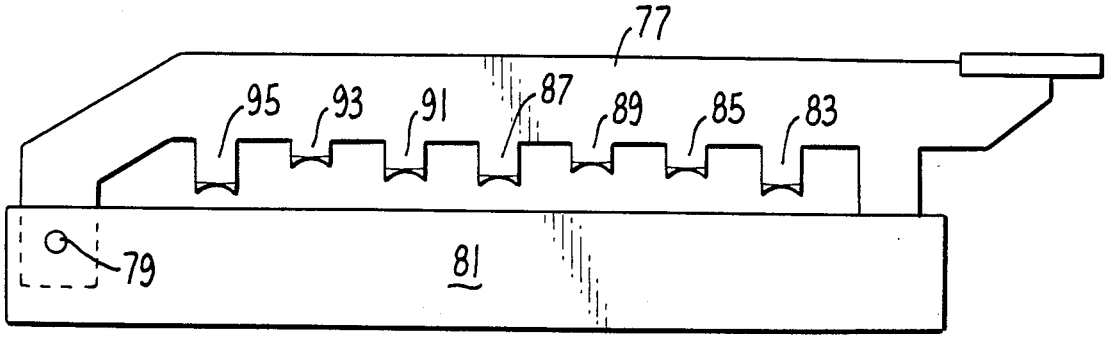
FIG. 9 is a side view of another embodiment of the punch.

Although in the embodiment shown in FIG. 6 punching takes place serially as the punches descend, it is frequently desirable to enhance this action by staggering the depth of the individual male punch elements as is shown in FIG. 9. The male punch elements are held on a bar 77 pivoted at 79 to the female punch assembly 81. The male punch elements are of different lengths as is shown in the drawing so that as the punch descends each element pierces the paper at a different time. Since the holes are punched one at a time, it is obvious that a minimum amount of force is necessary in order to punch a series of holes. Naturally the punch works best when the paper to be punched is held taut. However, it is ordinarily not necessary to provide any special means to hold the paper.

Although specific embodiments of the invention has been illustrated, it will be obvious to those skilled in the art that many variations can be made without departing from the spirit of this invention.

Subject matter to be claimed is:

1. A punch for punching a rectangular hole is a sheaf of paper or the like comprising in combination:

a. a male punch member having a rectangular shank and two, spaced apart, pointed piercing members, said piercing members being located at the ends of the punch and centrally of the sides of said punch and being bridged by a concave arcuate cylindrical surface and having evenly tapered concave, spherical side walls leading from said rectangular shank to said piercing members, b. a mating female socket member consisting of an elongated slot complementary to the square shank of the male member, c. whereby as said punch member descends into a sheaf of paper supported on said female member said punch first pierces at the extreme ends of the punch and then shears the sides of the hole as it passes down into said female member.

2. A punch having a plurality of male and female punch members as defined in claim 1 wherein said male punch members extend outwardly from a support bar, said bar being pivoted near one end of a frame member supporting a plurality of complementary female punch elements.

3. A punch in accordance with claim 2 wherein the male punch members extend at different distances from a support bar whereby as said bar descends holes are punched one at a time.

4. A punch in accordance with claim 2 wherein said support bar is actuated by a toggle linkage providing a mechanical advantage of the toggle linkage which increases as the actuating handle is moved downwardly.

* * * * *

UNITED STATES PATENT OFFICE

CERTIFICATE OF CORRECTION

Patent No. 4,706,533 Dated November 17, 1987

Inventor(s) Joe D. Giulie

It is certified that error appears in the above-identified patent and that said Letters Patent are hereby corrected as shown below:

Claim 1, line 1; "is" should be -- in --

Signed and Sealed this

Seventeenth Day of May, 1988

*Attest:*

*Attesting Officer*

DONALD J. QUIGG

*Commissioner of Patents and Trademarks*